United States Patent [19]

Peckinpaugh et al.

[11] 4,311,285

[45] Jan. 19, 1982

[54] YARN WINDING METHOD AND APPARATUS TO MAINTAIN TENSION DURING TAIL FORMATION

[75] Inventors: Frank L. Peckinpaugh; Kenneth R. Benton, Sr., both of Colonial Heights, Va.

[73] Assignee: Allied Corporation, Morris Township, Morris County, N.J.

[21] Appl. No.: 166,001

[22] Filed: Jul. 7, 1980

[51] Int. Cl.[3] ..... B65H 54/02; B65H 59/00

[52] U.S. Cl. ..... 242/18 PW

[58] Field of Search ..... 242/18 DD, 18 R, 18 A, 242/18 PW, 18 EW, 25 A, 35.5 A, 41, 45, 147 R; 57/299

[56] References Cited

U.S. PATENT DOCUMENTS

| | | | |
|---|---|---|---|
| 3,831,873 | 8/1974 | Bense | 242/45 |
| 3,873,044 | 3/1975 | Flower | 242/147 R |
| 4,081,149 | 3/1978 | Miller | 242/18 PW |

*Primary Examiner*—Stanley N. Gilreath

*Attorney, Agent, or Firm*—Richard A. Anderson

[57] ABSTRACT

A controlled, two-position lash point is used to maintain tension during tail formation while winding yarn. During winder string-up the lash point is in the lower "reachable" position. As the yarn is caught up on the winder to form a tail, the lash point is controlled to quickly move up to the upper winding position, thereby taking up slack during tail formation and maintaining tension to prevent breaking yarn.

12 Claims, 2 Drawing Figures

YARN WINDING METHOD AND APPARATUS TO MAINTAIN TENSION DURING TAIL FORMATION

BACKGROUND OF THE INVENTION

This invention relates to a yarn winding method and apparatus to maintain yarn tension during tail formation on a package formed on a winder from a running length of yarn. The yarn could be monofilament or multifilament, natural or synthetic. A transfer tail is defined in U.S. Pat. No. 4,081,149, hereby incorporated by reference, in toto. Controlling tension during automatic doffing which includes tail formation is an old problem which can be solved in various ways. For example, see U.S. Pat. No. 3,873,044, hereby incorporated by reference, and the patents listed in the specification and cited therein. See also U.S. Pat. No. 3,831,873.

DEFINITIONS

Lash point as used herein means the point, such as a guide, at which the running length of yarn leaves the last yarn source handling mechanism before entering the winder system traversing mechanism or tail forming mechanism.

String-up as used herein means the threading of the running length of yarn through the operating mechanisms, such as guides and the like, by an operator, usually manually.

Yarn package as used herein means a wound cake or multiple traversed layers of yarn on a tube, cone, pirn or the like, usually mounted on a winder chuck.

Reachable for string-up as used herein means the operator can physically reach the mechanism, such as a guide, to string it up standing on the floor without a ladder but using the usual yarn aspirator devices.

SUMMARY OF THE INVENTION

The invention is particularly adaptable for use with the winder described in U.S. Pat. No. 4,081,149 incorporated by reference above.

The process invention is the method for maintaining tension during tail formation of yarn on a winder comprising setting the lash point of the yarn path to the winder at a position closer to the winder during string-up of the winder, then moving the lash point to a position farther from the winder in a quick controlled manner at the time tail formation begins, and maintaining the lash point in the farther position during tail formation, thereby taking up the slack in the yarn during tail formation and maintaining tension on the yarn to prevent breaking the yarn. Preferably, the lash point moves quickly during the initial portion and more slowly during the final portion of its travel to the farther winding position. Also, preferably, the winder continues to wind yarn with a traversing motion to form a yarn package with the lash point at the position farther from the winder. The closer position of the lash point may be a lower position reachable for string-up of yarn onto the lash point.

The apparatus of this invention for maintaining tension during tail formation of yarn on a winder comprises a yarn winder having a chuck to carry a yarn package, means to rotate the winder chuck, means to traverse a running length of yarn across the chuck to form a yarn package form the running length of yarn, means to form a tail of yarn on the yarn package, a controlled, movable guide means to create a movable, controlled lash point for the running length of yarn as it runs between the movable guide means and the traverse means, means to move the movable guide means in a controlled manner, and a source of the running length of yarn. The means to move the guide means is controlled to move the guide means to a position closer to the winder during string-up of the winder and move the guide means farther from the winder in a quick, controlled manner at the time the tail formation means operate, thereby taking up the slack in the yarn during tail formation and maintaining tension on the yarn to prevent breaking the yarn. Preferably, the farther position is the position of the lash point during tranversing yarn to form a yarn package on the chuck of the winder. Also, preferably, the closer position is a lower position reachable for string-up of the yarn on the movable guide means. Preferably, the means to move the movable guide means include means to move the movable guide means quickly during the initial portion and more slowly during the final portion of travel of the guide means to the farther position. The means to move the movable guide means can be a sealed cylinder with a fluid driven slidable internal piston and attached shaft with rigid connections to the movable guide means. Also, the movable guide means can be mounted on a rigid mounting means having trippable switches mounted thereon so that the switches can be tripped by a member of the rigid connections to the movable guide means as it travels between positions. The switches activate a control system to control acceleration of the movable guide means as it moves to its farther position for tail formation of yarn on the yarn package. The fluid in the sealed cylinder can be preferably air under pressure or conventional hydraulic fluid. The control system can be electronic or preferably pneumatic. The preferred air under pressure fluid and pneumatic control system are used to control acceleration of the movable guide means so that the guide means moves quickly during the initial portion of its travel to the farther position and more slowly thereafter.

DESCRIPTION OF THE PREFERRED EMBODIMENT

Figure 1:
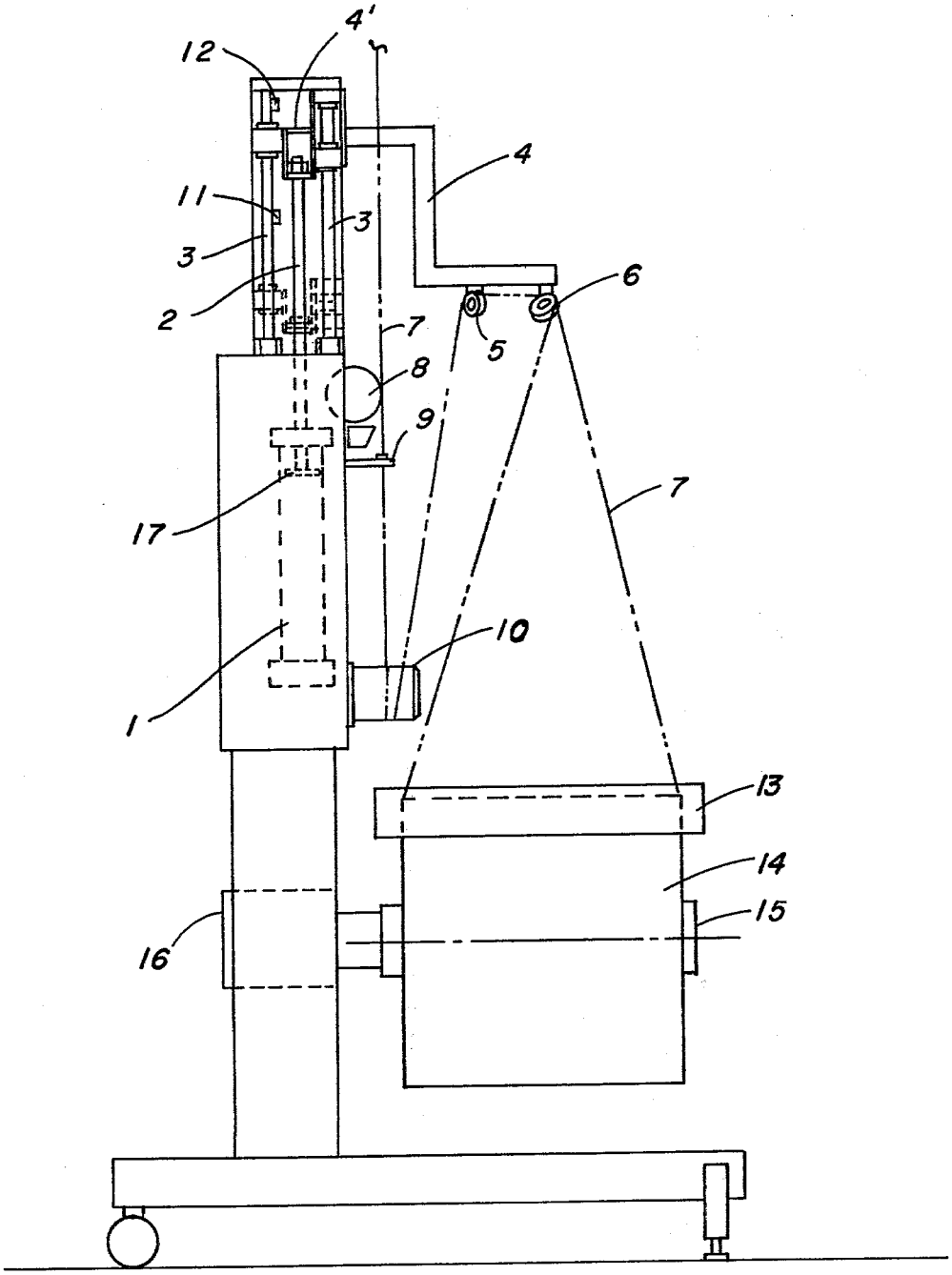
FIG. 1 is a schematic front view of a winder shown receiving yarn from a spinning position with the movable lash point of this invention.

In FIG. 1 a running length of yarn 7 comes from its source, passes across finish roll 8, and panel guide 9, to a driven godet roll 10, then passes to conventional roller guide 5 and roller guide 6 which is the lash point. From the lash point it is caused to transverse the winder package 14 by traversing mechanism 13 during package formation. Winder chuck 15 is driven by motor 16. The above yarn path is the description for the package formation mode of operation. For the string-up mode guides 5 and 6 on arm 4 are lowered by the control system of FIG. 2 by causing cylinder 1 to retract shaft 2 which is rigidly attached to arm 4 and slidably mounted in mounting system 3. Trippable switches 11 and 12 communicate with the control system of FIG. 2 and are tripped by the end of arm 4' passing within mounting system 3 as shown. For the tail forming mode of operation cylinder 1 containing a conventional air pressure driven piston 17 is activated by the control system of FIG. 2 quickly raising arm 4 by shaft 2. Guides 5 and 6 on arm 4 are thus quickly raised and the lash point becomes higher, as shown. As shaft 2 raises arm 4 it passes by and trips switch 11 communicating with the control system of FIG. 2 which slows the rate of acceleration of the lash point movement. When arm 4 trips switch 12 the control system of FIG. 2 acts on cylinder 1 so as to keep shaft 2 in the upper position for package formation.

The lower lash point position is reachable by a normal height person operating and stringing up the winder with the ordinary yarn aspirator. The movement from the lower to the upper position of the lash point takes up the slack in the running length of yarn when it is pulled from the yarn aspirator by the tail formation mechanism of the winder and is taken up or wound at a relatively slow speed on the winder package to form a tail as described in U.S. Pat. No. 4,081,149 above. This quick movement from lower to upper lash point takes up the slack or lower tension in the running length of yarn caused by tail formation and prevents the yarn from breaking due to the slack or low tension causing the running length of yarn to catch on a mechanism alongside but outside of its normal path, such as the winder drive roll, the guide mountings or a bad wrap on the godet or separator rolls.

Figure 2:
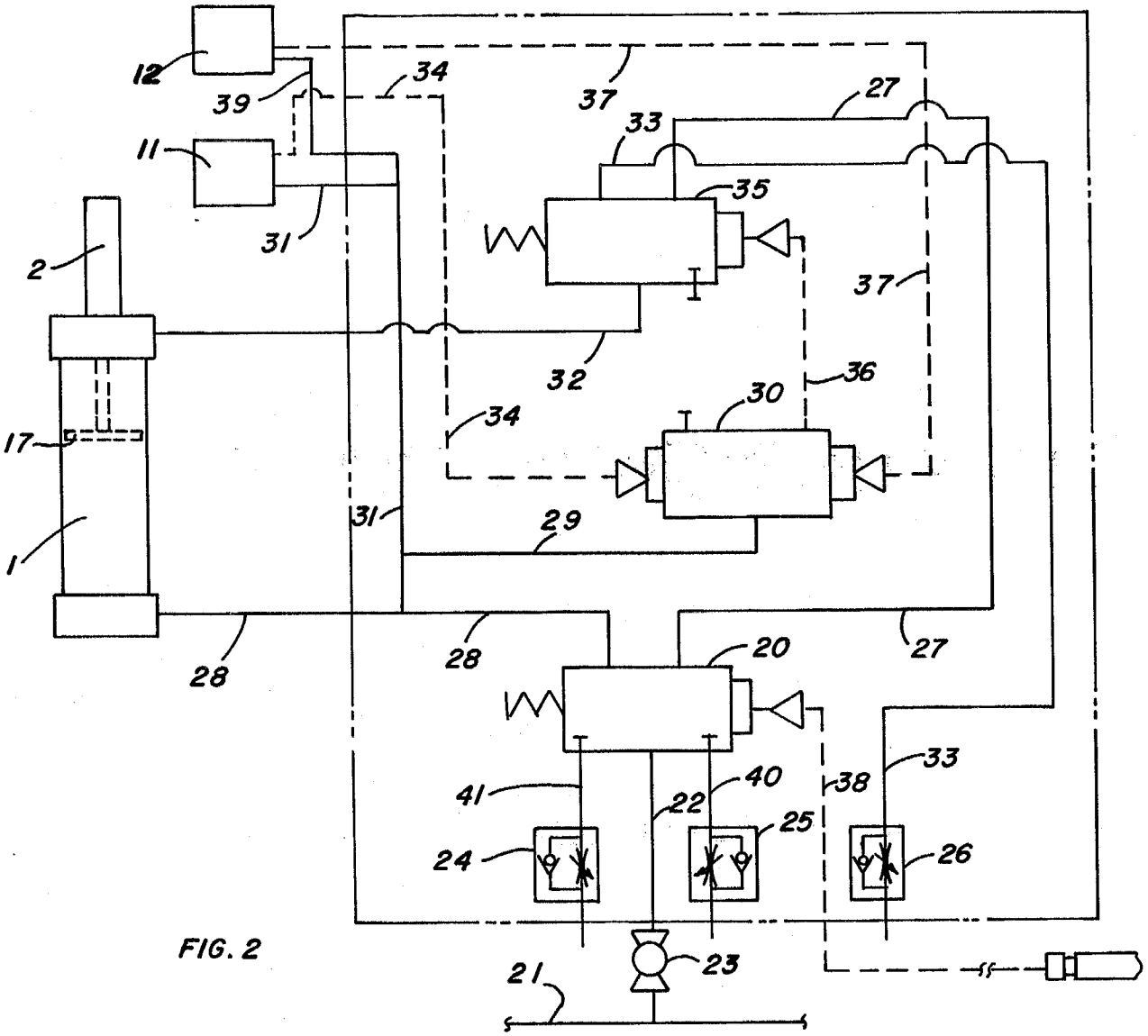
FIG. 2 is a schematic of the pneumatic control system and the pressure cylinder and piston means to move the lash point.

FIG. 2 shows the control system communicating with switches 11 and 12 and controlling movement of shaft 2 in cylinder 1 as described above. Like numbers indicate like members of apparatus in FIGS. 1 and 2. The main elements of the control system are the pneumatic switches or valves 20, 30 and 35 along with the flow controls 24, 25 and 26 on the exhausting pressurized air motive fluid for cylinder 1. The control system connects to the apparatus of FIG. 1 at the following places: top and bottom of cylinder 1 through lines 28 and 32, switches 11 and 12 through instrument low pressure air lines 34 and 37 and pressure source lines 31 and 39, line 38 to "up or down" switch 20 communicates to the winder control system and line 38 is pressure activated by the same button on the winder which puts the winder in the tail formation mode described in U.S. Pat. No. 4,081,149 above. Pressurized air or motive fluid is supplied to the system from header 21 through valve 23 and line 22 to "up or down" switch 20 and also through switch 20 through lines 28 and 29 to signal relay valve or switch 30 where it becomes low pressure or instrument air. Signal relay switch 30 is activated by signals with low pressure instrument air through lines 34 and 37 from switches 11 and 12 which in turn activates "fast or slow" valve or switch 35 through line 36 with low pressure instrument air. "Fast or slow" switch may be open to permit fast exhaust of pressurized air through lines 32, 27, switch 20 and line 40 to exhaust flow controller 25 which is set for fast exhaust. Alternatively, "fast or slow" switch 35 may be open to line 33 communicating with exhaust flow controller 26 which is set for slow exhaust flow of motive fluid (pressurized air).

The control system operates as follows; beginning with the lash point in the lower position and the yarn already strung up on it and ready to begin winder operation.

The operator puts the aspirator with the running length of yarn into the proper position; see U.S. Pat. No. 4,081,149, and pushes a button on the winder to cause it to begin the tail formation mode of operation. This causes the winder control system to send a signal through line 38 to switch 20 moving it into the position so it is valved open to permit motive air to flow from line 22 into line 28 to the bottom of cylinder 1 and it is valved open to permit exhaust air from top of cylinder 1 to flow through line 32 through switch 35, open to line 27 and out through line 40 and exhaust controller 25 which is set for fast exhaust. Motive air through line 28 from switch 20 causes the shaft 2 in cylinder 1 to rise by pressure on the piston 17 in cylinder 1. As shaft 2 quickly moves, switch 11 is tripped by arm 4, described previously. This causes a signal through instrument air line 34 to signal relay switch 30 to motivate switch 35 through instrument air line 36. Switch 35 is moved to open flow from line 32 through line 33 which communicates with flow controller 26 which is set for slow exhaust thereby slowing the speed of shaft as it rises.

When arm 4 rises to the farther position it trips switch 12 and a signal is sent through instrument air line 37 to signal relay switch 30 which resets switch 35 to open to line 27. The shaft 2 and lash point remain in the farther position from the winder. The winder has completed tail formation and has been or can now transverse the yarn to form a package on the chuck.

When the package is complete and ready for doffing, the operator pushes a button which causes the winder control system to remove the signal through line 38. This causes "up-down" switch 20 to open between lines 28 and 41 allowing the pressurized fluid in cylinder 1 to exhaust through controller 24, set for slow exhaust. The shaft 2 is thereby lowered, lowering the lash point to a position ready for string-up by the operator. After string-up, the sequence described is repeated.

We claim:

1. The method for maintaining tension during tail formation of yarn on a winder comprising setting the lash point of the yarn path to the winder at a position closer to the winder during string-up of the winder, then moving the lash point to a position farther from the winder in a quick controlled manner at the time fail formation begins, and maintaining the lash point in said farther position during tail formation, thereby taking up the slack in the yarn during tail formation and maintaining tension on the yarn to prevent breaking the yarn.

2. The method of claim 1 wherein said lash point moves quickly during the initial portion and more slowly during the final portion of its travel to the farther position.

3. The method of claim 1 wherein said winder continues to wind yarn with a traversing motion to form a yarn package with the lash point at the position farther from the winder.

4. The method of claim 3 wherein the closer position is a lower position, reachable for string-up of yarn onto the lash point.

5. An apparatus for maintaining tension during tail formation of yarn on a winder comprising a yarn winder having a chuck to carry a yarn package, means to rotate said winder chuck, means to traverse a running length of yarn across said chuck to form a yarn package from the running length of yarn, means to form a tail of yarn on said yarn package, a controlled, movable guide means to create a movable, controlled lash point for said running length of yarn as it runs between said movable guide means and said tranverse means, and means to move said movable guide means in a controlled manner, said means to move said movable guide means being controlled to move said guide means to a position closer to the winder during string-up of the winder and move said guide means farther from said winder in a quick, controlled manner at the time the tail formation means operates, thereby taking up the slack in the yarn during tail formation and maintaining tension on the yarn to prevent breaking the yarn.

6. The apparatus of claim 5 wherein said farther position is the position of the lash point during traversing yarn to form a yarn package on said chuck.

7. The apparatus of claim 5 wherein the closer position is a lower position reachable for string-up of yarn on said movable guide means.

8. The apparatus of claim 5 wherein said means to move said movable guide means includes means to move said movable guide means quickly during the initial portion and more slowly during the final portion of travel of the guide to the farther position.

9. The apparatus of claim 5 wherein said means to move said movable guide is a sealed cylinder with fluid driven slidable internal piston and attached shaft with rigid connections to said movable guide means.

10. The apparatus of claim 9 wherein said movable guide means is slidably mounted on a rigid mounting means having trippable switches mounted thereon so that the switches can be tripped by a member of said rigid connections to said movable guide means as it travels between positions, said switches activating a control system to control acceleration of said movable guide means as it moves to its farther position for tail formation of yarn on said package.

11. The apparatus of claim 10 wherein said fluid is air under pressure and said control system is pneumatic.

12. The apparatus of claim 11 wherein said control system controls acceleration of said movable guide means so that said movable guide means moves quickly during the initial portion of its travel to the farther position and more slowly thereafter.

* * * * *

UNITED STATES PATENT AND TRADEMARK OFFICE

CERTIFICATE OF CORRECTION

PATENT NO. : 4,311,285

DATED : January 19, 1982

INVENTOR(S) : Frank L. Peckinpaugh & Kenneth R. Benton, Sr.

It is certified that error appears in the above–identified patent and that said Letters Patent are hereby corrected as shown below:

Column 4, Line 42, "fail" should read --tail--

Signed and Sealed this

*Twenty-ninth* Day of *June 1982*

[SEAL]

*Attest:*

GERALD J. MOSSINGHOFF

*Attesting Officer*

*Commissioner of Patents and Trademarks*